US005782450A

United States Patent [19]

Spencer

[11] Patent Number: 5,782,450

[45] Date of Patent: Jul. 21, 1998

[54] ERGONOMIC STRESS-REDUCING DEVICE FOR COMPUTER KEYBOARDS AND THE LIKE

[76] Inventor: Richard C. Spencer, 20253 E. San Gabriel Valley Dr., Walnut, Calif. 91789

[21] Appl. No.: 500,283

[22] Filed: Jul. 10, 1995

[51] Int. Cl.[6] ..... A47G 29/00

[52] U.S. Cl. ..... 248/346.07; 248/118; 248/346.01; 248/918

[58] Field of Search ..... 248/118, 118.1, 248/118.3, 118.2, 346.01, 346.07, 346.3, 918; 108/69, 91; 211/194

[56] References Cited

U.S. PATENT DOCUMENTS

| | | | |
|---|---|---|---|
| 744,287 | 11/1903 | Brasel | 248/118.3 |
| 1,741,487 | 12/1929 | Vance | 248/188.2 |
| 2,955,888 | 10/1960 | Graves | 108/69 |
| 5,040,757 | 8/1991 | Benaway | 248/918 X |
| 5,118,095 | 6/1992 | Flor | 248/346.01 X |
| 5,251,556 | 10/1993 | Ravanelle et al. | 108/69 X |
| 5,375,800 | 12/1994 | Wilcox et al. | 248/918 X |
| 5,451,020 | 9/1995 | Smith et al. | 248/118 |
| 5,513,824 | 5/1996 | Leavitt et al. | 248/918 X |

*Primary Examiner*—Derek J. Berger
*Attorney, Agent, or Firm*—Sheldon & Mak

[57] ABSTRACT

The ergonomic device of the present invention relieves and prevents finger, hand and arm stress which normally accrue when a computer keyboard or the like is used over an extended period of time at an improper height with respect to the keyboard operator. The device includes a number of stacked releasably interconnected sheets of uniform or of varying thicknesses of from about ⅛ inch to about ½ inch, although other thicknesses are also suitable. The sheets operate as a support block for the keyboard, raising it to a heighth which prevents the aforementioned stress during use of the keyboard. The sheets preferably are of plastic or the like and preferably are color coded if they are of differing thicknesses, in order to facilitate their proper reassembly into the support block. The upper surface of the uppermost sheet is non-slip so that a computer keyboard will be held thereagainst without movement. Such upper surface can carry a plurality of spaced lines to help center the keyboard thereon. The outer perimeter of the sheets may be removable to change the effective length and width of the block. The sheets include releasably interlocking or mating studs and grooves and the lowermost sheet bears spaced depending, non-skid support legs. The device is simple, efficient and durable.

15 Claims, 3 Drawing Sheets

ERGONOMIC STRESS-REDUCING DEVICE FOR COMPUTER KEYBOARDS AND THE LIKE

BACKGROUND OF THE INVENTION

1. Field of the Invention

The present invention generally relates to stress-reducing devices and more particularly to an improved stress-reducing device for computer keyboards and the like.

2. Prior Art

Computers are now used by most people, both in the workplace and at home, for business and recreational purposes. Unfortunately, a large number of stress-related injuries have recently occurred which can be attributed to long-term repetitive use of computer keyboards and the like in an improper manner.

Such injuries include those to the fingers, hands, wrists, elbows and arms of the keyboard operator. Similar injuries arise during extended improper use of manual and electric typewriters and other similar devices which require repeated long-term hand manipulations.

The injuries referred to above include carpal-tunnel syndrome, tendonitis, synovitis and the like, accompanied by numbness, tingling, throbbing, burning, soreness and aching in the hands, fingers, hands, wrists, arms, elbows and/or neck. These injuries seriously impair the operator and require medical attention and rehabilitation of varying periods of time, depending on the severity of the injury.

Medical leave away from the workplace to cure such injuries represents an economic hardship to the employer as well as the employee, and a painful recovery period for the employee. Therefore, it is incumbent on both the employer and employee to make sure that the work-station is stress free and safe.

Such injuries can be prevented if proper attention is taken to set the computer, typewriter or the like at the proper heighth and distance from the operator and the operator is schooled concerning the proper finger, wrist, hand and arm position, as well as proper back and head posture during use of the computer or the like.

Thus, the display screen of the computer should be directly in front of the operator at a comfortable viewing distance, for example, about 18–24 inches. When the operator is seated in front of the screen, the top of the viewing screen should be no higher than eye level and the screen should be away from sources of glare or bright reflections. Any document holder should be positioned near and at the same level as the display screen foreasy viewing.

When typing on the computer or typewriter keyboard, the forearms and wrists should be level and parallel to the floor, with the elbows in a relaxed position near the body and the wrists in a natural relaxed and straight position. Arching, bending or angling of the wrists must be avoided. Thumbs and fingers must also be relaxed. These instructions cannot be complied with, however, if the keyboard is not at the proper height with respect to the seated operator.

Although there are devices on the market for tilting the keyboard, these have proved to be unacceptable for properly positioning the arms, wrists, hands and fingers of the operator with respect to the keyboard.

There remains a need for a simple, durable, efficient and inexpensive device which can properly position the keyboard so as to reduce, relieve and prevent stress to the body of the operator, particularly the arms, wrists, elbows, hands and fingers of the operator during use of the keyboard. Such device should be simple to assemble, adjust, disassemble and reassemble, and should be adaptable to a wide variety of sizes of keyboards and operator stations.

SUMMARY OF THE INVENTION

The improved ergonomic device of the present invention satisfies all the foregoing needs. The device is substantially as set forth in the ABSTRACT OF THE DISCLOSURE.

Thus, the device comprises a plurality, preferably four or more, of substantially identical flat plates or sheets of self-supporting material such as plastic or the like of suitable thickness such as about ⅛ to about ½ inch. The sheets may be of uniform or varying thickness and are releasably joined together in non-slip vertically stacked relation to form an adjustable height support block for a computer or typewriter keyboard or the like.

The uppermost sheet in the stack has an upper non-skid surface, such as one bearing a layer of rubber or the like, to prevent a computer keyboard from inadvertently moving thereon and may also have a plurality of spaced guidelines therein to facilitate centering of the keyboard thereon. The lowermost sheet in the stack has a bottom which includes means to prevent skidding of the assembled block. Preferably, such means include a plurality of spaced depending, non-skid legs bearing, for example, bottom rubber cups or shoes or the like.

Each sheet is of uniform thickness throughout, horizontally disposed in the stack and bears means to interlock it with adjacent sheets in the stack to form a unitary block. Such means include spaced studs or detents which fit into or mate with appropriately sized grooves or recesses in adjacent sheets to hold the stack of sheets in a solid block form.

In the event that the various sheets of the stack are of differing thicknesses, it is preferred that they be color coded to indicate their particular thickness and thus facilitate assembling and reassembling them.

In one embodiment, the length and width of the sheets can be adjusted due to the presence of outer removable perimeters. Various other features are set forth in the following detailed description and accompanying drawings.

DRAWINGS

DETAILED DESCRIPTION

FIGS. 1–3.

Figure 1:
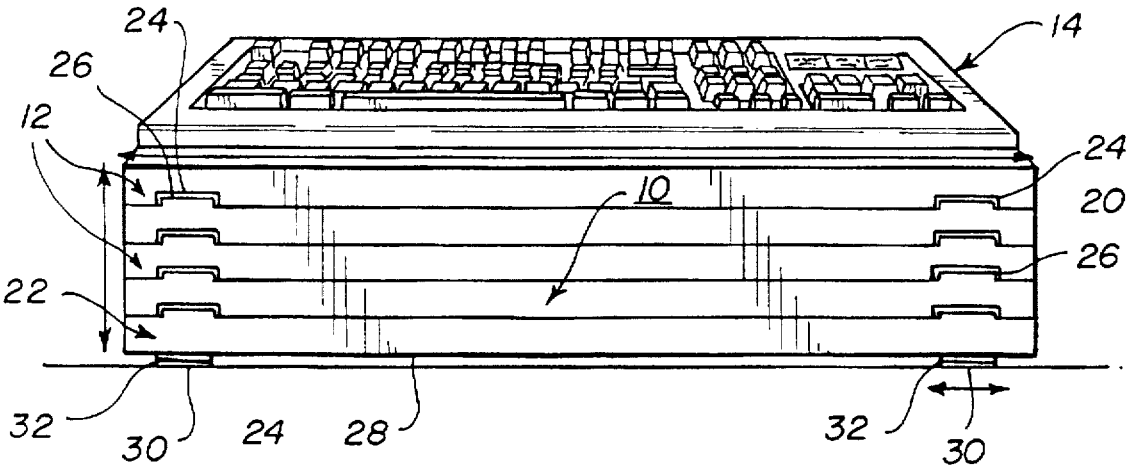
FIG. 1 is a schematic front elevation of a first preferred embodiment of the improved stress-reducing device of the present invention for use with computers, said device being shown supporting a computer keyboard.
Figure 2:
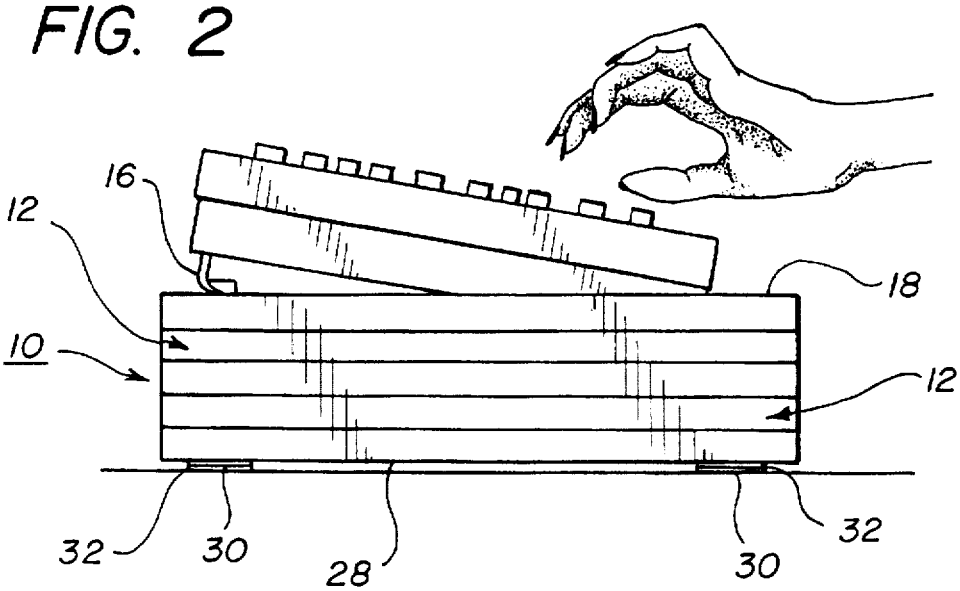
FIG. 2 is a schematic side elevation of the device of FIG. 1, showing the device supporting a computer keyboard and with an operator typing on the keyboard, with the fingers, hands, wrists and arms of the operator at a comfortable stress-preventing angle.
Figure 3:
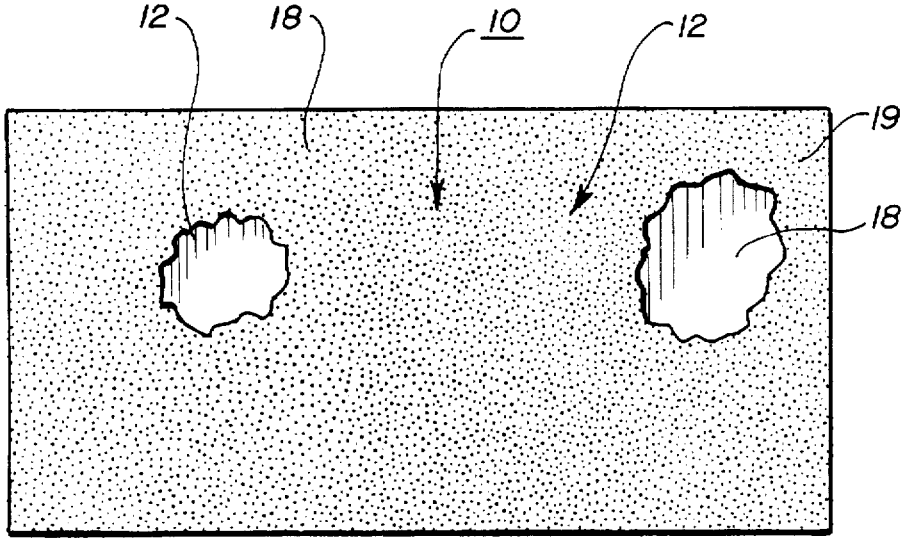
FIG. 3 is a schematic top plan view, partly broken away, of the device of FIG. 1.

Now referring to FIGS. 1–3 of the drawings, a first preferred embodiment of the improved ergonomic stress-relieving computer keyboard device of the present invention is schematically depicted therein. It will be understood that reference to a computer keyboard could also apply to another type of work-station keyboard such as a typewriter or the like.

Thus, device 10 is shown which comprises a plurality, in this instance, five vertically stacked self-supporting flat horizontal sheets 12 of uniform thickness, about ⅛ to about ½ inch in thickness, or of any other suitable thickness, and of sufficient length and width to fully support the entire length, width and weight of a computer keyboard or the like, such as keyboard 14 shown in FIGS. 1 and 2.

Keyboard 14 is supported at a proper typing angle, as by keyboard wedge 16 connected to the back of keyboard 14. Keyboard 14 fits against the flat horizontal upper surface 18 of the uppermost sheet 12 of stack 20 which forms support block 22. Surface 18 is non-slip, being formed of, for example, a layer 19 of rubber or the like.

Sheets 12 are preferably plastic, but can be of wood, metal, ceramic, hardened rubber or the like and are releasably connected together in non-slip fashion by a plurality of spaced studs 24 on sheets 12 fitting into or mating with suitably sized spaces or grooves 26 in adjoining sheets 12. In FIG. 1, studs 24 and grooves 26 are approximately rectangular in configuration, although other shapes are also suitable.

The bottom surface 28 of the lowermost sheet 12 of stack 20 has depending therefrom a plurality of spaced legs 30 fitted with non-skid bottom cups 32, so that block 22 will not move when keyboard 14 is used. Alternatively, legs 30 could themselves be made of non-skid material such as rubber or the like, or surface 24 could bear a layer (not shown) of non-skid material such as rubber or the like and dispense with legs 30.

Sheets 12 can be provided in a kit so that a sufficient number of sheets 12 can be assembled to form block 22 which is sufficiently high so as to raise keyboard 14 to a proper level to prevent stress on the operator when keyboard 14 rests on block 22 and is used by the operator. Thus, keyboard 14 can be easily adjusted in heighth using a suitable number of sheets 12 so that the proper angle of the fingers, hand, wrist and arm, generally designated 34, can be maintained by the operator, as shown in FIG. 2, for stress-free typing on keyboard 14.

Accordingly, device 10 is simple to assemble, use, disassemble, store and reassemble, as needed. It can be adjusted easily in heighth to suit the individual needs of the keyboard operator. Device 10 can be made in a variety of sizes, thicknesses, number of sheets 12, etc., to suit a variety of situations. Device 10 is efficient for preventing the development of physical ailments related to work stress.

FIG. 4.

Figure 4:
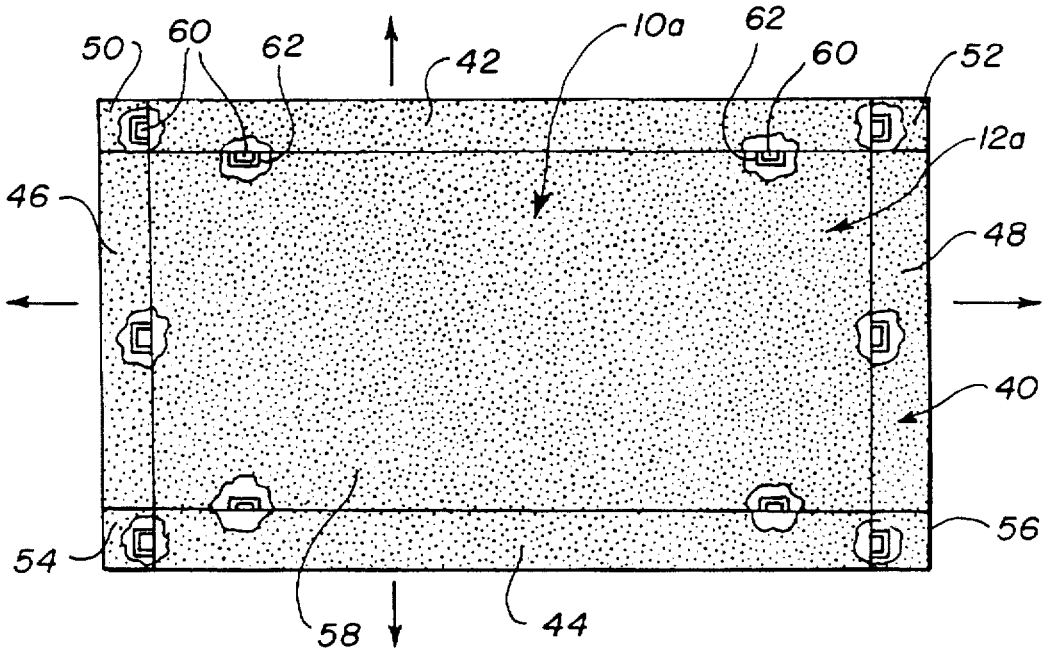
FIG. 4 is a schematic top plan view, partly broken away, of a second preferred embodiment of the improved device of the present invention.

A second preferred embodiment of the improved device of the present invention is schematically depicted in FIG. 4. Thus, device **10*a* is shown. Device 10*a* is similar to device 10. Components of device 10*a* which are similar to those of device 10** bear the same numerals but are succeeded by the letter "a".

Device **10*a* is substantially identical to device 10 in all respects, except that device 10*a* includes for each sheet 12*a* a removable peripheral border 40 comprising longitudinal strips 42 and 44, transverse strips 46 and 48 and corner pieces 50, 52, 54 and 56 releasably secured to central rectangular plate 58 and to each other by spaced pins generally designated 60 frictionally engaged in recesses generally designated 62. With such an arrangement, the length and width of sheet 12*a* can be adjusted by retaining or removing one or more of strips 42, 44, 46 and 48 and corner pieces 50, 52, 54 and 56. Device 10*a* has the other functions and advantages of device 10**.

Figure 5:
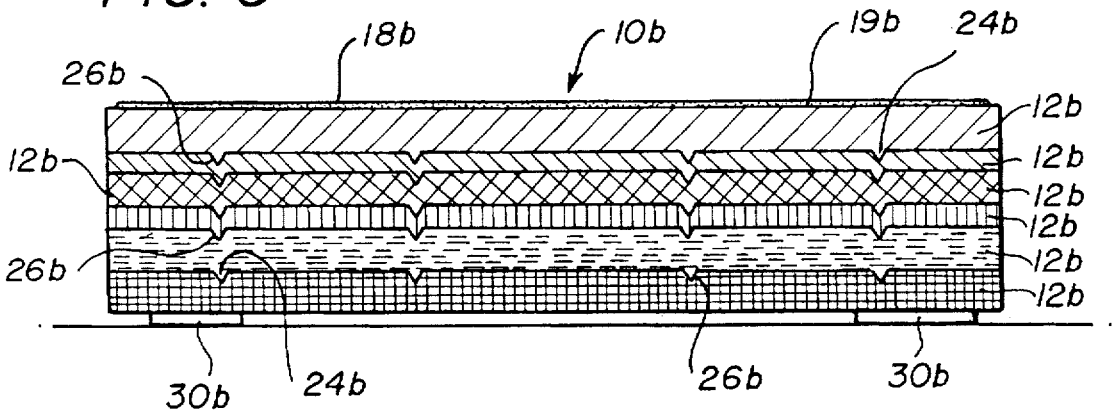
FIG. 5 is a schematic front elevation of a third preferred embodiment of the improved device of the present invention; and, FIG. 6 is a schematic top plan view of the device of FIG. 5.
Figure 6:
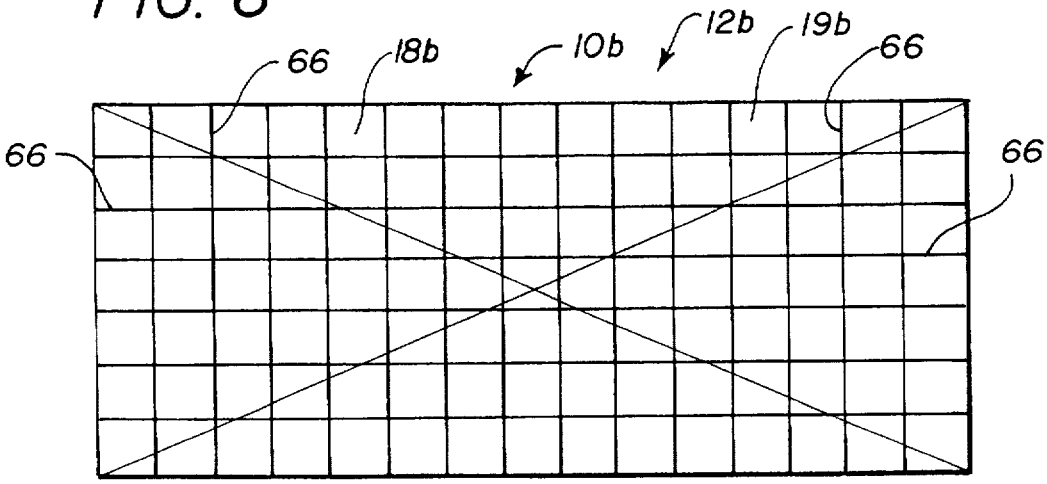

FIGS. 5 and 6.

A third preferred embodiment of the improved device of the present invention is schematically depicted in FIGS. 5 and 6. Thus, device **10*b* is shown. Components thereof similar to those of device 10 or device 10*a*** bear the same numerals but are succeeded by the letter "b".

Device **10*a* is substantially identical to device 10**, except as follows:

a) Sheets **12*b*** are of different thicknesses and comprise 6 sheets instead of 5 sheets.

b) Each sheet **12*b* of a given different thickness is color coded, that is, has a different body color, so as to help in reassembling a block 22*b*** of a given total thickness.

c) Legs **30*b* are made of non-slip material such as rubber and do not rely on cups such as cups 32 of device 10**.

d) Upper surface **18*b* of top sheet 12*b* has layer 19*b* thereof scored into a plurality of spaced longitudinal and transverse score lines 66 which aid in centering a keyboard thereon and which increase the anti-slip characteristics of layer 19*b***.

e) Studs **24*b* and grooves 26*b* are generally triangular or wedge-shaped in front elevation, as shown in FIG. 5**.

Device **10*b* has the other advantages of device 10**. Various other changes, modifications, alterations and additions can be made in the improved device of the present invention, its components and parameters. All such changes, modifications, alterations and additions as are within the scope of the appended claims form part of the present invention.

What is claimed is:

1. An ergonomic support for computer keyboards, the support comprising, in combination:

a) a plurality of stacked shape-retaining computer keyboard-supporting sheets, each sheet being of controlled thickness, width and length, the uppermost of the sheets in the stack having non-slip means thereon bearing spaced keyboard-centering lines, the lowermost of the sheets in the stack having a bottom surface including a non-slip means; and b) means integral with the sheets releasably interconnecting the sheets in the stack into a solid support block;

c) wherein the sheets are of differing thicknesses of from about ⅛ inch to about ½ inch thick for customizing the height of the keyboard for maximum stress-relieving effect, and d) wherein the sheets are of differing colors to indicate the differing thicknesses of the sheets for any reassembly of the support.

2. The support of claim 1, wherein the integral interconnecting means comprises mating studs and grooves carried by the sheets so that the sheets releasably interlock to form the support block.

3. The support of claim 1, wherein the sheets are of a uniform thickness of from about ⅛ inch to about ½ inch and differ only in that the non-slip means of the lowermost sheet further comprises a plurality of spaced non-slip support legs.

4. The support of claim 3, wherein the sheets comprise plastic.

5. The support of claim 1, wherein the sheets include removable margins at the outer periphery thereof for changing the width and length of the sheets.

6. An ergonomic stress-reducing assembly comprising the support of claim 1 and a keyboard.

7. An ergonomic support for computer keyboards, the support comprising, in combination:

a) a plurality of stacked shape-retaining computer keyboard-supporting sheets, each sheet being of controlled thickness, width and length, the uppermost of the sheets in the stack having non-slip means thereon bearing spaced keyboard centering lines, the lowermost of the sheets in the stack having a bottom surface including a non-slip means;

b) means integral with the sheets releasably interconnecting the sheets in the stack into a solid support block; and c) wherein the sheets include removable margins at the outer peripheries thereof for changing the width and length of the sheets.

8. The support of claim 7, wherein the sheets are of differing thicknesses of from about ⅛ inch to about ½ inch thick.

9. The support of claim 8, wherein the sheets are of differing colors to indicate the differing thicknesses of the sheets.

10. The support of claim 7, wherein the integral means comprises mating studs and grooves carried by the sheets.

11. The support of claim 7, wherein the sheets are of a uniform thickness of from about ⅛ inch to about ½ inch.

12. The support of claim 7, wherein the sheets comprise plastic.

13. An ergonomic stress-reducing assembly comprising the support of claim 7 and a keyboard.

14. A method for reducing the strain on the operator of a keyboard resting on a support area, comprising:

a) providing the ergonomic support of claim 1, and b) positioning the ergonomic support between the keyboard and the support area.

15. The method of claim 14, further including the step of interlocking the sheets.

* * * * *